US010914144B2

(12) United States Patent
Hardesty et al.

(10) Patent No.: US 10,914,144 B2
(45) Date of Patent: Feb. 9, 2021

(54) PROPPANT TRANSPORT EFFICIENCY SYSTEM AND METHOD

(71) Applicant: GEODYNAMICS, INC., Millsap, TX (US)

(72) Inventors: John T. Hardesty, Fort Worth, TX (US); Wenbo Yang, Kennedale, TX (US); James A. Rollins, Lipan, TX (US); Kevin Wutherich, Millsap, TX (US); Ross Harvey, Millsap, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 16/483,082

(22) PCT Filed: Feb. 2, 2018

(86) PCT No.: PCT/US2018/016688
§ 371 (c)(1),
(2) Date: Aug. 2, 2019

(87) PCT Pub. No.: WO2018/144901
PCT Pub. Date: Aug. 9, 2018

(65) Prior Publication Data

US 2019/0376372 A1 Dec. 12, 2019

Related U.S. Application Data

(60) Provisional application No. 62/454,563, filed on Feb. 3, 2017.

(51) Int. Cl.
*E21B 43/117* (2006.01)
*E21B 43/119* (2006.01)
(Continued)

(52) U.S. Cl.
CPC ..... *E21B 43/117* (2013.01); *E21B 43/119* (2013.01); *E21B 43/11855* (2013.01);
(Continued)

(58) Field of Classification Search
CPC ..... E21B 43/11; E21B 43/116; E21B 43/119
See application file for complete search history.

(56) References Cited

U.S. PATENT DOCUMENTS 9,145,763 B1 9/2015 Sites, Jr.
9,562,421 B2 2/2017 Hardesty et al.
(Continued)

FOREIGN PATENT DOCUMENTS

EP 3101221 A1 12/2016
GB 2430551 A 3/2007

OTHER PUBLICATIONS

International Search Report and Written Opinion, dated May 18, 2018, from corresponding/related International Application No. PCT/US2018/016688.

(Continued)

*Primary Examiner* — Tara Schimpf
(74) *Attorney, Agent, or Firm* — Patent Portfolio Builders PLLC

(57) ABSTRACT

A perforating gun system with at least one gun. Each of the perforating guns have charges disposed in a gun carrier that are angled to the longitudinal axis of the gun to achieve a predetermined proppant transport profile into clusters within a stage in a well casing. The perforation tunnels may also have burrs on each side of the casing and acts in initially aiding proppant transport during fracture treatment. A method of tuning a cluster to achieve a desired fracturing treatment based on a feedback from another cluster includes selecting a hole diameter, a hole angle for creating an angled opening, a discharge coefficient, and a proppant efficiency.
(Continued)

Moreover, a method of improving perforation charge efficiency.

19 Claims, 15 Drawing Sheets

(51) Int. Cl.
*E21B 43/1185* (2006.01)
*E21B 43/267* (2006.01)
*F42B 1/036* (2006.01)
*F42B 12/76* (2006.01)

(52) U.S. Cl.
CPC ..... *E21B 43/267* (2013.01); *F42B 1/036* (2013.01); *F42B 12/76* (2013.01)

(56) References Cited

U.S. PATENT DOCUMENTS 9,725,993 B1 8/2017 Yang et al.
2001/0050172 A1 12/2001 Tolman et al.
2005/0194146 A1* 9/2005 Barker ..... E21B 43/119 166/298
2005/0247447 A1 11/2005 Spring et al.
2006/0118303 A1* 6/2006 Schultz ..... E21B 43/119 166/297
2009/0078420 A1 3/2009 Caminari et al.
2010/0269676 A1 10/2010 Behrmann et al.
2011/0036571 A1* 2/2011 Vitalievich ..... E21B 43/267 166/280.1
2013/0008655 A1* 1/2013 Le ..... E21B 43/1195 166/297
2015/0267516 A1* 9/2015 Hardesty ..... E21B 43/117 175/3.5
2017/0275975 A1 9/2017 Hardesty

OTHER PUBLICATIONS

Extended European Search Report in corresponding/related European Application No. 18 748 281.5 dated Oct. 26, 2020. (References not submitted herewith have been previously made of record.).
European Office communication in corresponding/related European Application No. 18 748 281.5 dated Nov. 12, 2020.

* cited by examiner

FIG. 13A

| Table 1 | |
|---|---|
| Hole Size | 0.4 inch dia. |
| Estimated Cv | 0.65 |
| Injection Rate | 80 BPM |
| # of perfs | 36 perfs |
| | |
| Rate/ Perf @ 100% Efficiency | 2.22 BPM/Perf |
| Rate/ Perf @ 90% Efficiency | 2.47 BPM/Perf |
| Rate/ Perf @ 80% Efficiency | 2.78 BPM/Perf |
| Rate/ Perf @ 70% Efficiency | 3.17 BPM/Perf |
| Rate/ Perf @ 60% Efficiency | 3.7 BPM/Perf |
| Rate/ Perf @ 50% Efficiency | 4.44 BPM/Perf |
| Rate/ Perf @ 40% Efficiency | 5.56 BPM/Perf |
| | |
| Pressure Loss/Perf @ 100% Efficiency | 909 psi |
| Pressure Loss/Perf @ 90% Efficiency | 1,122 psi |
| Pressure Loss/Perf @ 80% Efficiency | 1,420 psi |
| Pressure Loss/Perf @ 70% Efficiency | 1,855 psi |
| Pressure Loss/Perf @ 60% Efficiency | 2,525 psi |
| Pressure Loss/Perf @ 50% Efficiency | 3,636 psi |
| Pressure Loss/Perf @ 40% Efficiency | 5,681 psi |

FIG. 13B

| Table 2 | |
|---|---|
| Hole Size | 0.4 inch dia. |
| Estimated Cv | 0.75 |
| Injection Rate | 80 BPM |
| # of perfs | 36 perfs |
| | |
| Rate/ Perf @ 100% Efficiency | 2.22 BPM/Perf |
| Rate/ Perf @ 90% Efficiency | 2.47 BPM/Perf |
| Rate/ Perf @ 80% Efficiency | 2.78 BPM/Perf |
| Rate/ Perf @ 70% Efficiency | 3.17 BPM/Perf |
| Rate/ Perf @ 60% Efficiency | 3.7 BPM/Perf |
| Rate/ Perf @ 50% Efficiency | 4.44 BPM/Perf |
| Rate/ Perf @ 40% Efficiency | 5.56 BPM/Perf |
| | |
| Pressure Loss/Perf @ 100% Efficiency | 683 psi |
| Pressure Loss/Perf @ 90% Efficiency | 843 psi |
| Pressure Loss/Perf @ 80% Efficiency | 1,067 psi |
| Pressure Loss/Perf @ 70% Efficiency | 1,393 psi |
| Pressure Loss/Perf @ 60% Efficiency | 1,896 psi |
| Pressure Loss/Perf @ 50% Efficiency | 2,731 psi |
| Pressure Loss/Perf @ 40% Efficiency | 4,267 psi |

FIG. 13C

| Table 1 | |
|---|---|
| Hole Size | 0.4 inch dia. |
| Estimated Cv | 0.75 |
| Injection Rate | 92 BPM |
| # of perfs | 36 perfs |
| | |
| Rate/ Perf @ 100% Efficiency | 2.56 BPM/Perf |
| Rate/ Perf @ 90% Efficiency | 2.85 BPM/Perf |
| Rate/ Perf @ 80% Efficiency | 3.2 BPM/Perf |
| Rate/ Perf @ 70% Efficiency | 3.66 BPM/Perf |
| Rate/ Perf @ 60% Efficiency | 4.27 BPM/Perf |
| Rate/ Perf @ 50% Efficiency | 5.13 BPM/Perf |
| Rate/ Perf @ 40% Efficiency | 6.41 BPM/Perf |
| | |
| Pressure Loss/Perf @ 100% Efficiency | 909 psi |
| Pressure Loss/Perf @ 90% Efficiency | 1,122 psi |
| Pressure Loss/Perf @ 80% Efficiency | 1,420 psi |
| Pressure Loss/Perf @ 70% Efficiency | 1,855 psi |
| Pressure Loss/Perf @ 60% Efficiency | 2,524 psi |
| Pressure Loss/Perf @ 50% Efficiency | 3,635 psi |
| Pressure Loss/Perf @ 40% Efficiency | 5,680 psi |

PROPPANT TRANSPORT EFFICIENCY SYSTEM AND METHOD

CROSS-REFERENCE TO RELATED APPLICATIONS

The present application is a National Stage of PCT Application No. PCT/US2018/016688, filed Feb. 2, 2018, which claims the benefit of priority under 35 U.S.C. § 119(e) to U.S. Provisional Patent Application Ser. No. 62/454,563, filed Feb. 3, 2017, entitled "PROPPANT TRANSPORT EFFICIENCY SYSTEM AND METHOD," the technical disclosure of which is hereby incorporated by reference in its entirety.

TECHNICAL FIELD

The present disclosure relates generally to perforation guns that are used in the oil and gas industry to explosively perforate well casing and underground hydrocarbon bearing formations, and more particularly to an improved gun system and method for improving proppant transport efficiency in a well casing.

BACKGROUND

During a cased wellbore completion process, a gun string assembly is positioned in an isolated zone in the wellbore casing. The gun string assembly comprises a plurality of perforating guns coupled to each other using connections such as threaded tandem subs. The perforating gun is then fired, creating holes through the casing and the cement and into the targeted rock. These perforating holes then allow fluid communication between the oil and gas in the rock formation and the wellbore. During the completion of an oil and/or gas well, it is common to perforate the hydrocarbon containing formation with explosive charges to allow inflow of hydrocarbons to the wellbore. These charges are loaded in a perforation gun and are typically "shaped charges" that produce an explosively formed penetrating jet that is propelled in a chosen direction when detonated. When a charge in a perforating gun system is detonated and the well perforated, entrance holes are created in the well casing and explosives create a jet that penetrates into the hydrocarbon formation. The "quality" of the perforations is important when considering the overall stage design. For example, the "quality" of perforations is determined by the entrance hole diameter and the perforation tunnel shape, length, and width. The diameter of the entrance hole depends upon a number of factors, including but not limited to, the nature of the liner in the shaped charge, the explosive type, the thickness and material of the casing, the water gap in the casing, centralization of the perforating gun, number of perforations in a cluster and number of clusters in a stage. Due to the number of factors that determine the entrance hole size, the variation of the entrance hole diameter can be large and consequently affects the predictability of the stage design. Once the plug and perforations are placed, fracturing slurry, a mixture of a fluid and proppant, is injected into the well casing and is dispersed through the perforations along the well casing. The fraction of proppant entering the heel-ward clusters is often unintentionally lower than the fraction of proppant entering into the toe-ward clusters. The terms "heel-ward" and "toe-ward" are used herein to describe the locations relative to a slurry flow path. For example, the clusters that are exposed to the slurry first may be described as "heel-ward" clusters, whereas the clusters that are exposed to the slurry last just before reaching the toe, may be described as "toe-ward" clusters. The terms "heel" and "toe" are used herein to describe locations along a horizontal stage. For example, the "heel" of the stage is in an upstream end relative to the slurry flow path and the "toe" of the stage is a downstream end along the slurry flow path just prior to the plug. Without being bound by any particular theory, it is believed that in some instances with high wellbore flow rate, proppant particle inertial difference heel to toe-ward clusters may be large, preventing thus reducing the rate at which proppant particles enter into the heel-ward clusters relative to the toe-ward end. This is especially the case with smaller hole diameters and the traditional hole geometry. Consequently, fluid leaks into the heel-ward perforations while the concentration of proppant in the slurry increases and eventually exits in the middle or toe-ward perforations. In some other instances, unintentional heel-ward bias is also possible, for example, at slow flow rates proppant settling occurs through perforations existing on the low side of a casing with respect to a gravitational vector.

There are a number of existing techniques used to control proportions within clusters by using sealants such as ball sealers, solid sealers, or chemical sealers that plug perforation tunnels, effectively limiting the flow rate through the heel-ward cluster while diverting fluid toward toe-ward clusters. However the effectiveness of these plugging techniques is limited due to the wide variations in hole diameters and penetration depths of the tunnels.

SUMMARY OF THE INVENTION

In accordance with an exemplary embodiment, there is provided a perforating gun and perforating gun system with a plurality of guns. Each of the perforating guns have charges that are disposed within a gun carrier that may be cylindrical in shape. The charges, which may be reactive or non-reactive shaped charges, are arranged to form clusters in a well casing and may be angled to achieve a target proppant transport profile in a stage.

In accordance with another aspect, there is provided an exemplary embodiment of a method for perforating that includes the step of providing a perforating gun system with charges disposed within a gun carrier. Further, the method includes selecting a configuration for each shaped charge and deploying the gun system into the well casing in a stage. The gun system is used in perforating the stage and creating clusters, with each cluster having a set of perforating tunnels oriented in a predetermined arrangement.

The foregoing is a brief summary of some aspects of exemplary embodiments and features of the invention. Other embodiments and features are detailed here below and/or will become apparent from the following detailed description of the invention when considered in conjunction with the accompanying drawings.

BRIEF DESCRIPTION OF THE DRAWINGS

The novel features believed characteristic of the inventions are set forth in the appended claims. The figures presented here are schematic, not drawn to scale, and illustrate aspects of exemplary embodiments. In the figures, each identical or substantially similar component is represented by a single numeral or notation.

FIGS. 13A-C are tables provided to illustrate the influence of various factors on the discharge coefficient.

DETAILED DESCRIPTION

To facilitate the discussion and description of the various embodiments of the perforating gun system, descriptive conventions may be used to describe the relative position or location of the features that form the perforating gun system as well as relative direction. For example, the terms "low side" and "high side" describe inner circumferential locations on a casing based on a gravitational vector. The term "low side" refers to the side of the casing to which is more susceptible to collecting settled proppant at low flow rates, and the term "high side" refers to the side of the casing which is more susceptible to have low proppant transport compared to the low side when slurry flow rates are low.

Figure 1:
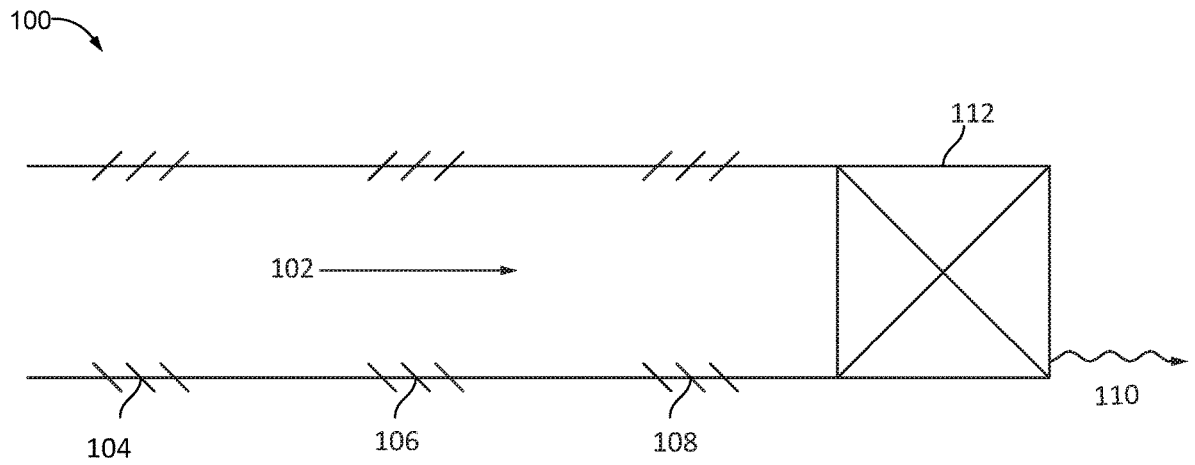
FIG. 1 is a schematic view of a stage perforated by an exemplary perforating gun.

FIG. 1 is a schematic view of a stage 100 perforated by an exemplary perforating gun. A "stage" used herein is a predetermined interval in a wellbore casing which is to be isolated before creating perforations and pumping fracturing fluid. In an exemplary plug-and-perf completion, a plug 112 is placed downstream of a stage of a wellbore casing. In one example, a perforation gun system (not shown) is placed into the stage 100 and perforates to create a number of perforation tunnels forming two or more clusters such as heel-ward cluster 104, middle cluster 106, and toe-ward cluster 108. The term "cluster" used herein is a group of one or more perforation tunnels located at predetermined distances apart along the length of a stage. For example, cluster 104 is made up of several perforation tunnels around the circumference of a cross-sectional area of a stage and is spaced from cluster 106 by a predetermined distance along the length of the stage. After perforation, fracturing fluid is pumped into the stage 100 with a flow rate directed from a heel-ward side to toe-ward side of the stage 100. Each perforation cluster 104, 106, and 108 is associated with a flow rate of fracturing fluid entering into each cluster and a leak flow rate 110 is also shown for fracturing fluid flow rate through the plug 112.

Figure 2:
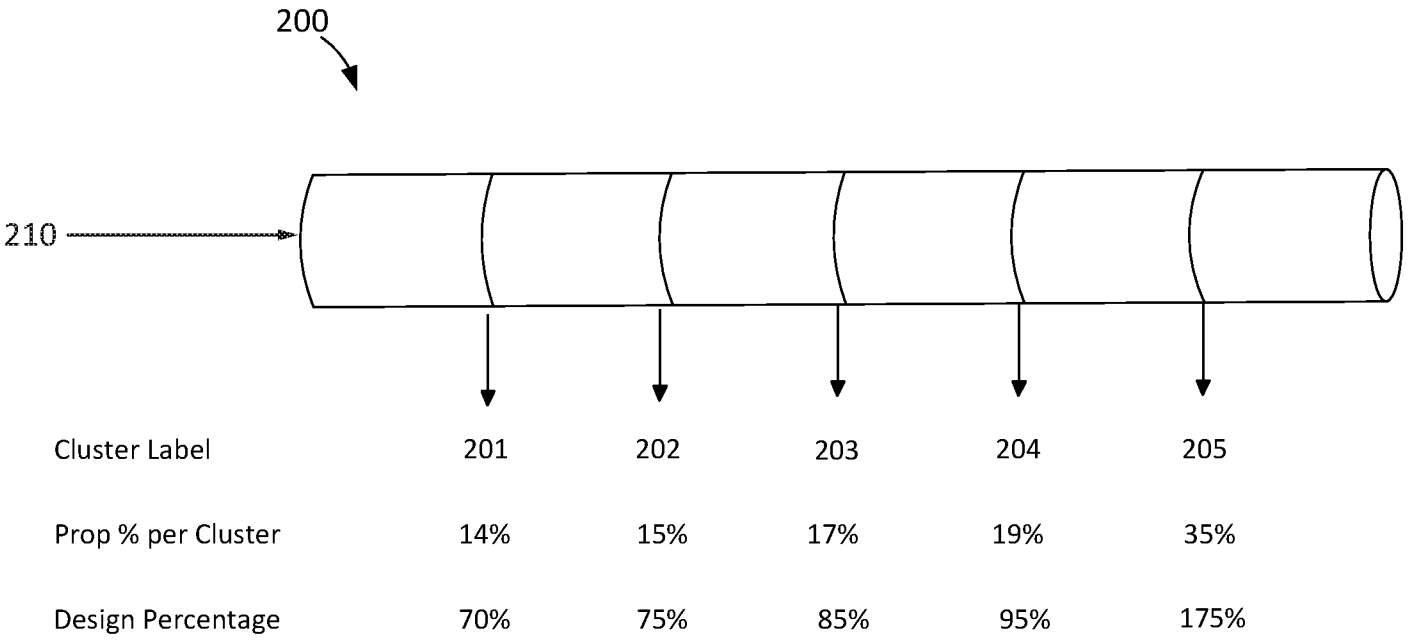
FIG. 2 illustrates the proppant distribution in an exemplary stage with five clusters.

FIG. 2 illustrates the proppant distribution in an exemplary stage 200 with five clusters 201, 202, 203, 204, and 205. Stage 200 assumes that an equal flow rate of the fracturing fluid 210 flows through each cluster. Despite equal fluid flow, the proppant concentration in the fracturing slurry is biased in the toe-ward cluster 205. For example, FIG. 2 shows 14 wt. % of the total proppant distributed amongst the clusters entering the heel-ward cluster 201. The percentage increases until reaching the toe-ward cluster 205 which receives 35 wt. % of the total proppant distributed amongst all clusters in the stage. In this example, the uneven proppant distribution could cause bridging of the toe-ward cluster 205 while creating preferential fracture stimulation on the heel-ward clusters such as 201 and 202.

It is possible for proppant concentration bias to occur in the toe, heel, or middle clusters. Proppant and fluid distribution to clusters may be observed using systems such as distributed temperature sensing (DTS), distributed acoustic sensing (DAS), and microseismic monitoring during fracturing. In particular, particle transport efficiency ($E_i$) may be calculated by finding the ratio of the measured mass flow rate of proppant into a reference perforation and the measured mass flow rate of proppant transport upstream of the reference perforation. Moreover, a fluid flow ratio is calculated by taking a ratio of the measured volumetric fluid flow rate through a reference perforation and the measured volumetric fluid flow rate upstream of the reference perforation. For example, the particle transport efficiency ($E_i$) at a particular perforation (i) may be defined as follows:

$$E_i = C_{perf,i} * q_{perf,i} / C_{ref,i} * q_{ref,i} \quad (1)$$

$C_{perf,i}$ is the solids concentration in the slurry through the perforation (i)

$C_{ref,i}$ is the solids concentrations in the slurry upstream of the perforation (i)

$q_{perf,i}$ is the volumetric flow rate of the slurry through the perforation (i)

$q_{ref,i}$ is the volumetric flow rate of the slurry upstream of the perforation (i)

Notice that the function $E_i$ is dependent in part on the slurry flow ratio and a proppant concentration may be calculated using the correlation from Equation (1).

These ratios tend to show that proppant transport efficiency may be negatively impacted by higher proppant concentration, increased flow rates, and larger casing diameter. In general, proppant transport efficiency in the fracture network is extremely important for long-term fracture conductivity. Some factors that affect particle efficiency include fluid viscosity, proppant density, proppant size, and formation permeability. It is also possible to calculate a pressure drop in a perforation using the following equation:

$$\Delta P = 0.2369\frac{Q^2\rho}{n^2D^4C_v^2} \tag{2A}$$

$$C_v = 0.56 + 1.65\times10^{-4}M,\ (C_v \le 0.89) \tag{2B}$$

ΔP is the perforation pressure drop
$C_v$ is the discharge coefficient
ρ is the density of the injected fluid (lbm/gal)
Q is the total flowrate through the perforations (bbl/min)
M is the total mass of proppant passed through perforations (lbm)
D is the diameter of the entrance hole of the perforation (in)
n is the number of unplugged perforations The discharge coefficient is dependent on the total mass of proppant entered into active perforations and may be improved by optimizing the number of active perforations.

For example, based on the foregoing, selecting angled charges that create angled perforations may prevent bridging of less active perforations and also increase the total mass of proppant entering heelward perforations. Consequently, smaller entrance hole diameters may advantageously be used for the same flow rate and the same pressure drop. Small entrance hole diameters may be desirable if smaller diameter guns are used with smaller charges with less explosive weight. For example, a 0.4 inch entrance hole diameter may be reduced to 0.3 inch entrance hole diameter due to improved discharge coefficient. The 0.3 inch entrance hole diameter may be created by smaller charges with lesser explosive weight and therefore require a smaller gun diameter. The diameter of the gun may be reduced by at least 20% by improving the discharge coefficient. For example, a 2⅞ inch diameter may be used instead of a standard 3⅛ inch diameter perforating gun, by improving the discharge coefficient. In addition, the charge weight may be reduced by at least 20% with an improved discharge coefficient because the opportunity for hole size reduction.

Other factors related to the tuning of perforation gun systems may also have an impact on proppant transport efficiency and discharge coefficient. These factors include but are not limited to angled perforation tunnels, burrs, and entry hole diameter size. Angled perforation tunnels are depicted schematically in FIGS. 3A-3B while burrs are depicted schematically in FIG. 4.

Figure 3A:
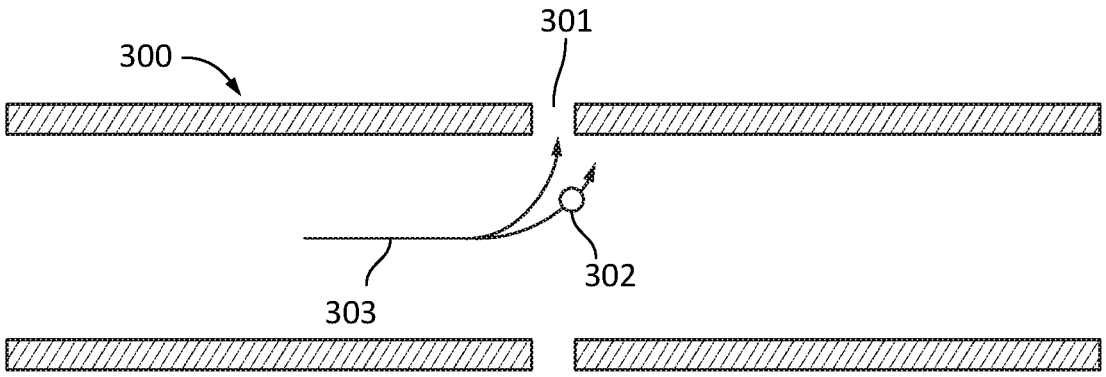
FIG. 3A Prior Art
FIG. 3A illustrates fluid and proppant flow in the Prior Art through perforations in a well casing made by a conventional gun system.
Figure 3B:
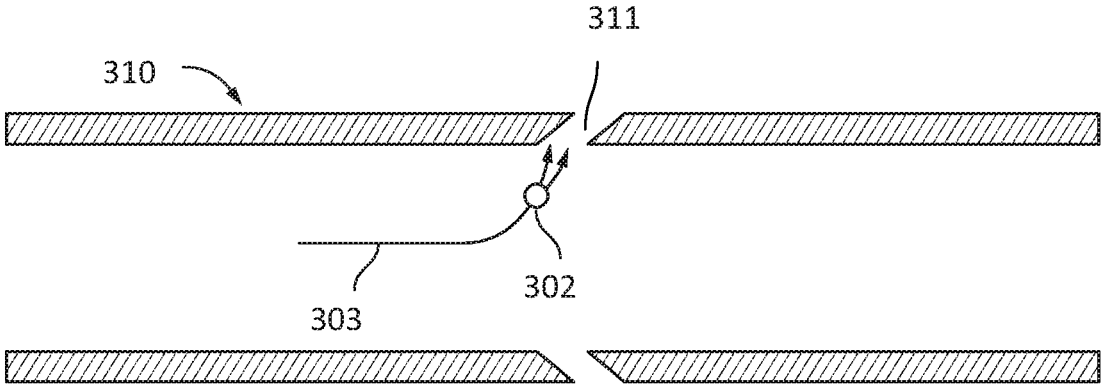
FIG. 3B illustrates fluid and proppant flow through perforations in a well casing made by an exemplary perforating gun.

FIG. 3A (prior art) illustrates fluid and proppant flow through perforations in a well casing made by a conventional gun system and FIG. 3B illustrates fluid and proppant flow through perforations in a well casing made by an exemplary perforating gun of the present disclosure. Exemplary casing 300 shows slurry 302, 303 traveling along the longitudinal axis of the casing and an exemplary perforation tunnel angled perpendicular to a longitudinal axis of the casing as created by a typical perforating gun. The term "slurry" used herein is a mixture of at least a fluid fraction 303 and a proppant fraction 302 used to fracture openings in a formation. For example, at typical slurry flow rates used to deploy proppants, proppant particle 302 may bypass tunnels such as 301 in FIG. 3A located in heel-ward clusters because they are unable to make the abrupt turn into the perforation tunnel 301. While not bound by any particular theory, the proppant inertia to making a turn at the heel-ward clusters can influence the proppant transport efficiency throughout the clusters in a stage causing more fluid in the slurry to preferentially leak into the heel-ward clusters while proppant particles in the slurry flows onward and accumulates in the toe-ward clusters. Creating an angled perforation tunnel oriented in the toe-ward direction, as in FIG. 3B, in the casing and through the hydrocarbon formation may help direct a larger concentration of proppant into the perforation tunnel. In FIG. 3B the casing 310 shows an angled perforation 311 oriented toe-ward (i.e. with fluid and proppant entrance heel-ward and exit toe-ward) with respect to the longitudinal axis. Proppant particle 302, without being bound to any particular theory, is able to enter the perforation with more ease because it is subjected to a less severe turn into the angled perforation when compared to a perforation 301 oriented perpendicular to the longitudinal axis. The angle of the perforation tunnels may be adjusted to influence the proppant transport into the tunnels. For example, to reduce a potential toe-ward proppant bias, heel-ward clusters may include perforation tunnels angled in the toe-ward direction and toe-ward clusters may include perforation tunnels that are not angled in the toe-ward direction or are less angled toward the toe-ward direction relative to the longitudinal axis. Moreover a range of perforation angles in the middle cluster or clusters are possible to achieve desired activity at each cluster along a stage. For example, the average angles of the perforation tunnels in four clusters from heel-ward to toe-ward in a stage may be 30°, 30°, 45° and 60° relative to a longitudinal axis of a gun (or of the casing). In this example, the objective may be to increase the fraction of proppant entering into the heel-ward cluster and to decrease the fraction of proppant entering in the toe-ward cluster. In another example, the average angles of the perforation tunnels in four clusters from heel-ward to toe-ward in a stage may be 60°, 45°, 45° and 30° relative to a longitudinal axis of a gun. In this example, the objective may be to increase the fraction of proppant entering into the toe-ward cluster and to decrease the fraction of proppant entering in the heel-ward cluster. It may be appreciated that the angles of the perforation tunnels in a particular cluster may be generally uniform, or may include a range of different angles ranging from 30 to 90 degrees relative to the longitudinal axis.

In addition to adjusting angles of perforations to achieve desired proppant transport efficiency, adjusting the geometry of the perforation tunnels in the hydrocarbon formation is also possible using precision shaped charge design described in U.S. Pat. No. 9,725,993 B1, and hereby incorporated to the extent pertinent. For example, the term "precision shaped charge" describes a perforating design that allows for creating tailored perforation tunnels with less entrance hole size variation from target entrance hole sizes. For example, a 0.35 inch perforation entry hole diameter charge may create entrance holes in a casing with a substantially constant 0.35 inch diameter regardless of changes in design and environmental factors such as casing diameter, gun diameter, thickness of the well casing, composition of the well casing, position of the charge in the perforating gun, position of the perforation gun in the well casing, water gap in the casing, or type of hydrocarbon formation. For example, each precision shaped charge may be modified to create varying hole sizes by adjusting any one of or a combination of the following: aspect ratio (radius to height of liner), subtended angle of the liner inside of the charge, and explosive load weight. The effect of adjusting charge design provides tailorable, constant entrance hole diameter and perforation tunnel length allowing for improved predictability of proppant transport amongst clusters.

Furthermore, arranging charges to be angled in a gun causes the gun clearance between the inner gun wall and the charge to be increased. The term "standoff" used herein describes the distance between a shaped charge and the target. Accordingly, an angled charge inside of a gun carrier allows for longer standoffs. In addition, the gun clearance can be manipulated with the same charge in different gun configurations in order to tune the perforation geometry such as hole size, and consistency of entrance hole geometry irrespective of environmental factors. Furthermore, lower gram weight charges may be used with better effect, and packed at higher shot densities. Although a bank of charges may be all angled in one direction, the angle may be adjusted so that the holes in the casing are positioned within a shorter linear interval, for instance within 1-2 inches, even though the charges may take up to 20 inches of gun length, effectively reducing the cluster interval length in the casing.

Figure 4:
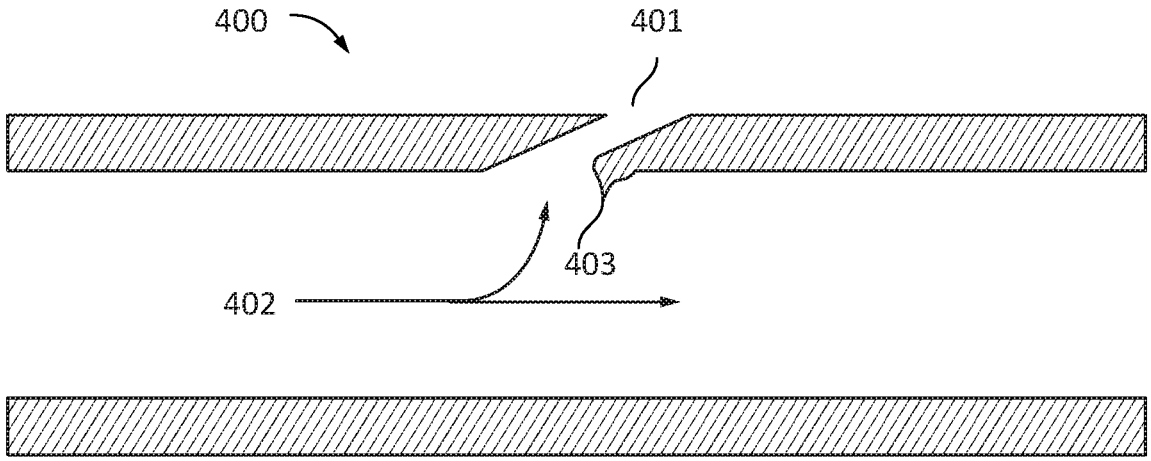
FIG. 4 is a view of a burr created with an exemplary perforating gun system.

In addition to entrance hole diameter, the geometry of the entrance hole in the casing may also influence proppant transport as illustrated in FIG. 4. FIG. 4 is a view of a burr 403 created with an exemplary perforating gun system. A "burr," used herein is a feature of a perforation geometry, which can occur on either side of a casing, caused by an explosive blast such as a precision shaped charge. It is possible to influence the position and shape of the burr 403 by modifying the design of a shaped charge and the angle of the perforation into the casing. FIG. 4 is an example of a burr 403 shown in a perforation 401 that is angled in the toe-ward direction. In the inner side of the casing, the burr 403 is located on the toe side of the perforation 401 entrance hole and functions to initially divert slurry 402 into the perforation tunnel until the burr 403 is worn away and before the entrance hole size expands from erosion. In an exemplary embodiment, the angled charges may create repeatable angled and oblong perforation tunnels in a casing, for example, perforations may be 0.40 inches wide and 0.5 inches long with an inner burr 403. Field studies have shown that the discharge coefficient is improved with angled perforations as well as an increased diversion of proppant attributed to hole geometry and backstop burrs.

Figure 5:
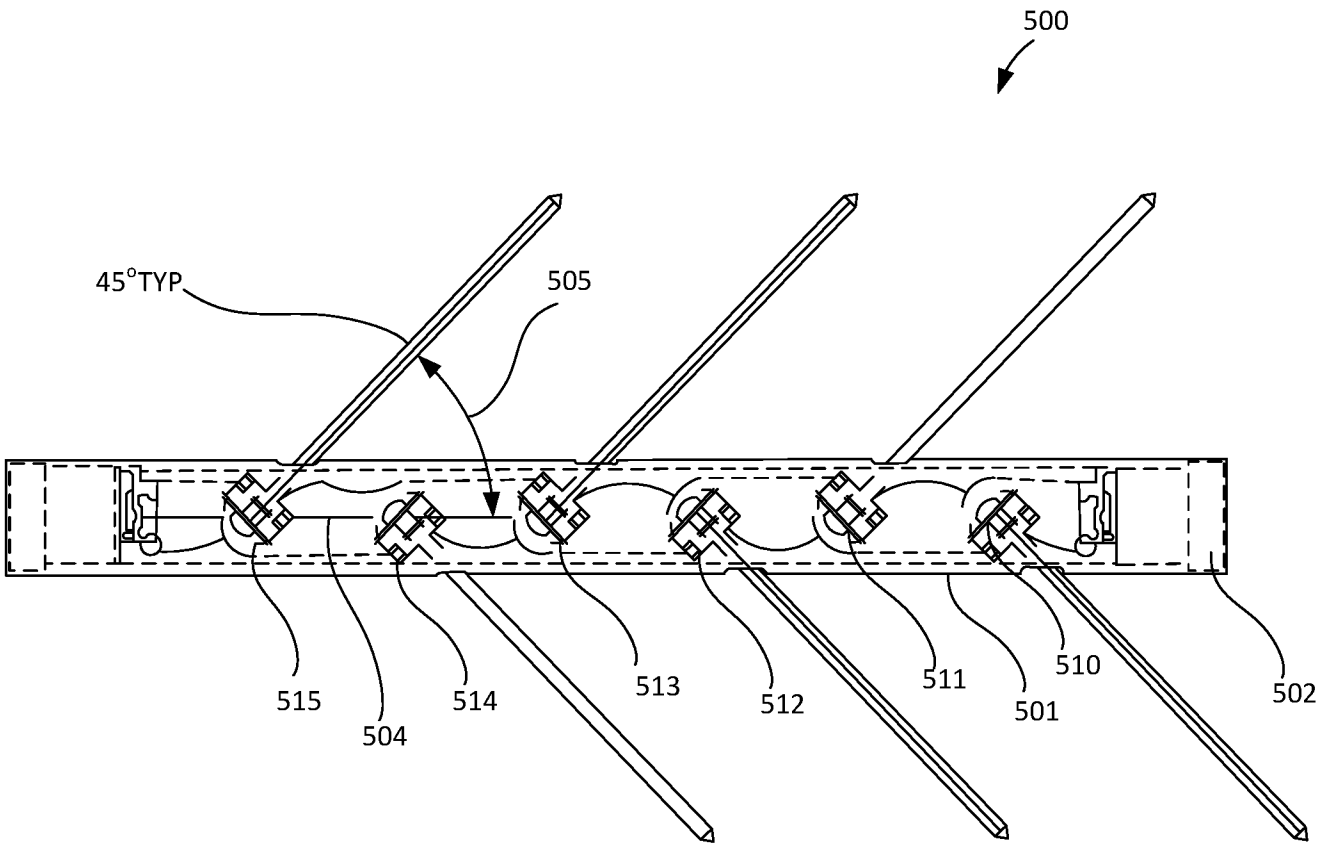
FIG. 5 is an illustrative cross section view of an exemplary perforating gun with angled charges.

FIG. 5 is a cross section view of an exemplary perforating gun with angled charges. The system may be 0-180° phased, as shown, or phased at any other constant phasing (such as 60°, 90°, 120°) or non-constant phasing. In one embodiment shown in FIG. 5, three space charges 510, 512, 514 are oriented at one side of charge holder tube ("0° phased charges") and three space charges 511, 513, 515 are oriented at the opposite side of a charge holder tube ("180° phased charges"). Alternatively, there may be an unequal number of charges oriented at each phase.

The perforations can be arranged in banks and also can take advantage of interbank phasing to statistically target low stress zones described in US 2017/0275975A1. After a stage has been isolated for perforation, a perforating gun string assembly may be deployed and positioned in the isolated stage. The gun string assembly may include a string of perforating guns mechanically coupled to each other through tandems or subs or transfers. The GSA may orient itself such that the charges 510, 511, 512, 513, 514, 515 inside a charge holder tube 502 are angularly oriented. The charges may be oriented with a metal strip. The angle 505 as measured from the longitudinal axis 504 may range from 5° to 90°. According to one exemplary embodiment, the angle may range from 15° to 60°. According to another exemplary embodiment, the angle may range from 30° to 45°. The spacing between the spaced charges 510, 511, 512, 513, 514, 515 may be equal or unequal depending on distance required to achieve the desired orientation.

Figure 6B:
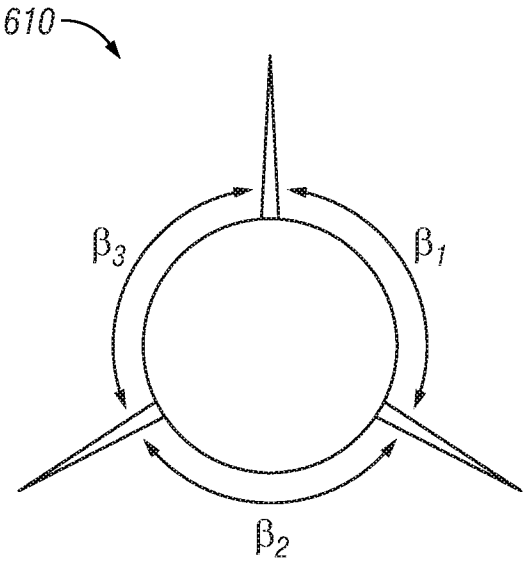
FIG. 6B is an end view of the perforating gun system to illustrate phasing angles around the gun system.
Figure 6A:
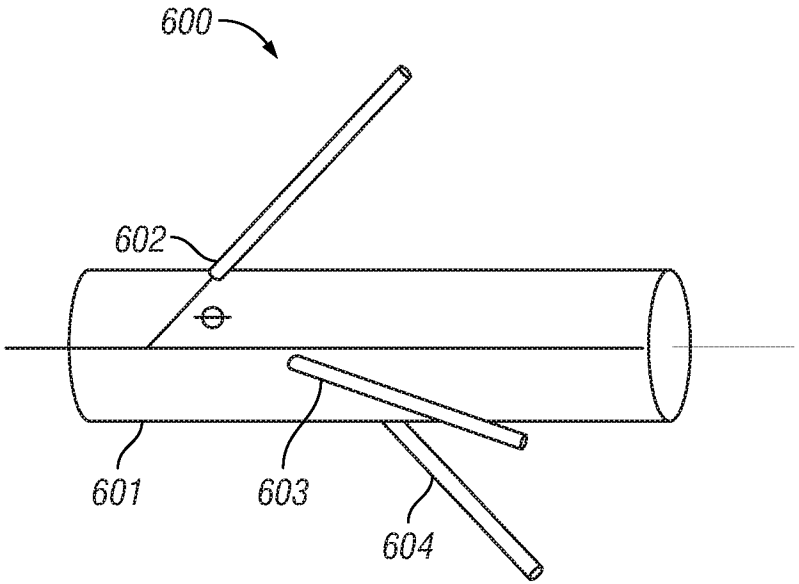
FIG. 6A is an exemplary angled gun system having uniform charge angles.

FIG. 6A illustrates an exemplary angled gun system having uniform charge angles. For example, charges 602, 603, and 604 are each at angle θ from the longitudinal axis of the perforating gun 601. In one embodiment, angle θ may be 45°. Alternatively, any angle may be used to orient the charges including a traditional 90° angle relative to the longitudinal axis depending on the objective proppant transport through a particular cluster. Moreover the use of precision shaped charges may also be used in an exemplary embodiment.

FIG. 6B is an end view 610 of the perforating gun 601 to illustrate phasing degrees of $\beta_1$, $\beta_2$, and $\beta_3$. The figure shows each of the charges to be radially spaced at equal phasing around the gun system. For example, for constant phasing with patterns of three charges, $\beta_1$, $\beta_2$, and $\beta_3$ may each be 120° apart. For constant phasing with patterns of two charges, $\beta_1$ and $\beta_2$ may be 180°. Additional embodiments may include other phasing schemes including constant and non-constant phasing schemes. For example, for non-constant phasing, $\beta_1$, $\beta_2$, and $\beta_3$ may be different values.

Figure 7:
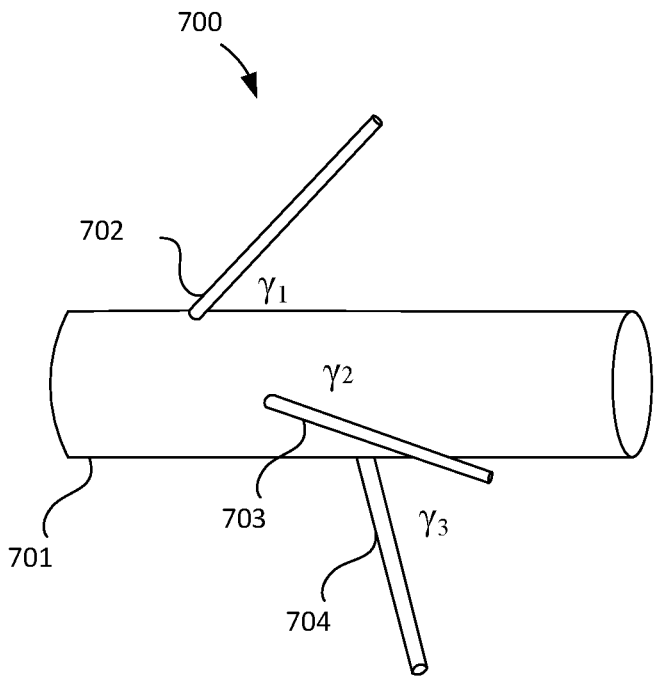
FIG. 7 illustrates an exemplary angled gun system having non-uniform charge angles.

FIG. 7 depicts exemplary angled gun 701 having non-uniform charge angles relative to the longitudinal axis of the perforating gun. For example, charges 702, 703, and 704 are angled at $\gamma_1$, $\gamma_2$, and $\gamma_3$ respectively to the longitudinal axis of the perforating gun 701 and are shown as radially spaced around the gun at 120 degrees apart. Alternatively, any range of angles may be used to orient the charges including a traditional 90° angle relative to the longitudinal axis depending on the objective proppant transport through a particular cluster. Moreover the use of precision shaped charges may also be used in an exemplary embodiment. The number of perforations per cluster may range from 1 to 20 and the number of clusters in a stage may range from 1 to 24.

Figure 8A:
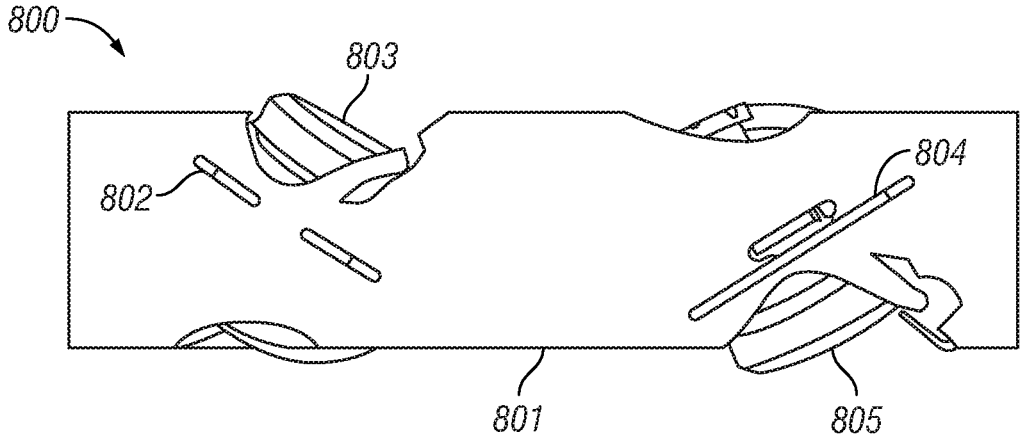
FIGS. 8A and 8B are perspective views of an exemplary perforating gun with charges angled at $\alpha$ degrees relative to a longitudinal axis of the perforating gun.
Figure 8B:
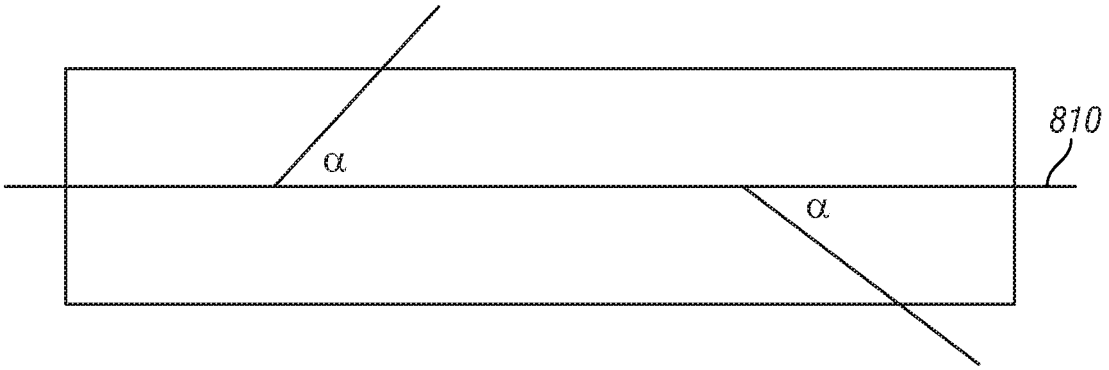

FIGS. 8A and 8B are perspective views of an exemplary perforating gun with charges angled at α degrees relative to a longitudinal axis 810 of the perforating gun. For example, in one embodiment, α may be 30°. It is possible to angle the charges as described in U.S. Pat. No. 9,562,421 B2, and hereby incorporated to the extent pertinent. The gun assembly of an embodiment may comprise the cylindrical gun body with a barrel (load tube) disposed inside. The barrel may comprise multiple precision cut slots allowing the charge case to be inserted into the barrel and subsequently rest on the support strip 802, 804. The holes may be located on any side of the circumference of the barrel to achieve the desired target perforations. The holes are preferably cut through the barrel wall at an angle perpendicular to the plane of the orientation of the support strip 802, 804. A shaped charge case may be disposed in a hole in a support strip 802, 804 resting on a projection on the circumference of the charge case. The spacing between each charge on the support can be adjusted and the flat support base can be inserted at various angles within the support member to accurately control the intended perforating target. This flat surface 802, 804 provides a solid base for securing the shaped charge 803, 805 and the round tubing provides the structure needed to form a rigid geometric frame. In one embodiment, a flat support strip 802, 804 may be used as described. In other embodiments concave or convex geometries can also be used as the support base to optimize charge performance.

Figure 9:
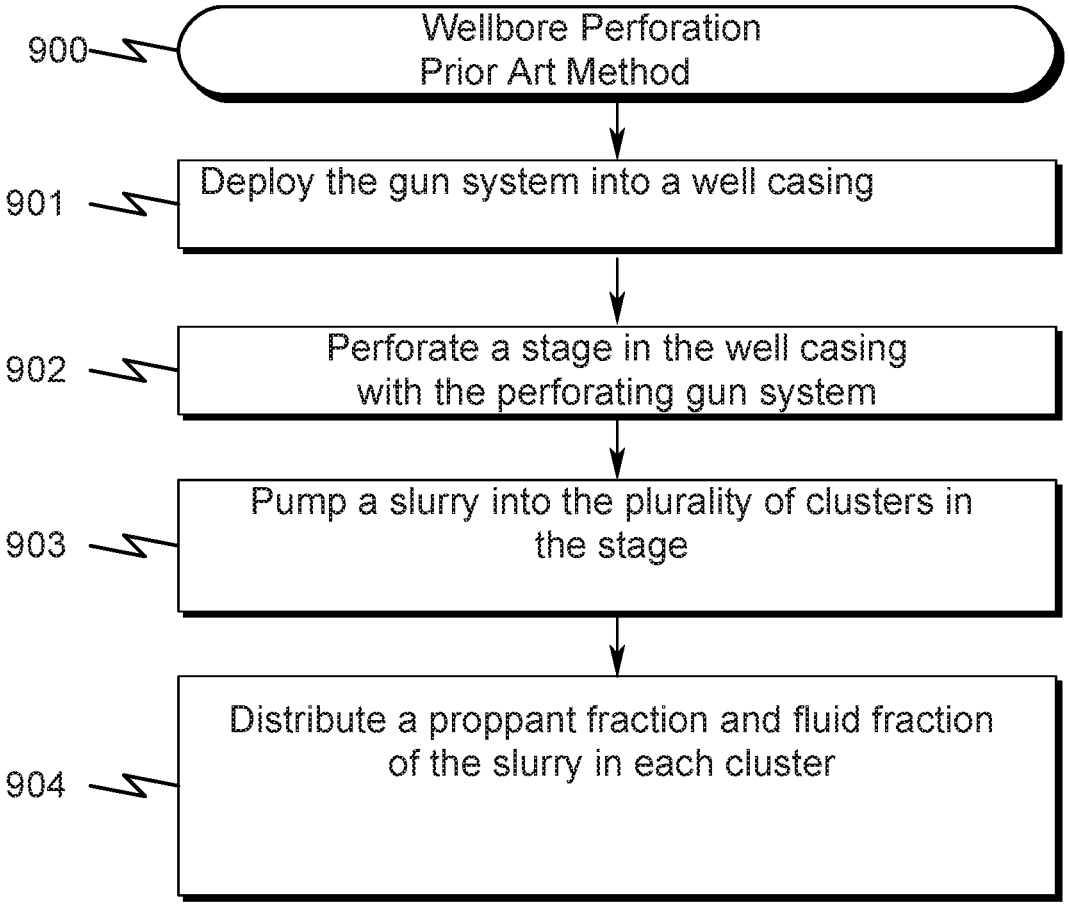
FIG. 9 Prior Art
FIG. 9 is a simplified flowchart of a method using a perforating gun system of the prior art.

FIG. 9 is a simplified flowchart of an exemplary method depicting some of the steps using a perforating gun system of the prior art. The method 900 includes the following steps: deploying the gun system into a well casing in step 901; perforating a stage in the well casing with the perforating gun system in step 902; pumping a slurry into the plurality of clusters in the stage in step 903; and distributing a proppant fraction and fluid fraction of the slurry in each cluster in step 904.

Figure 10:
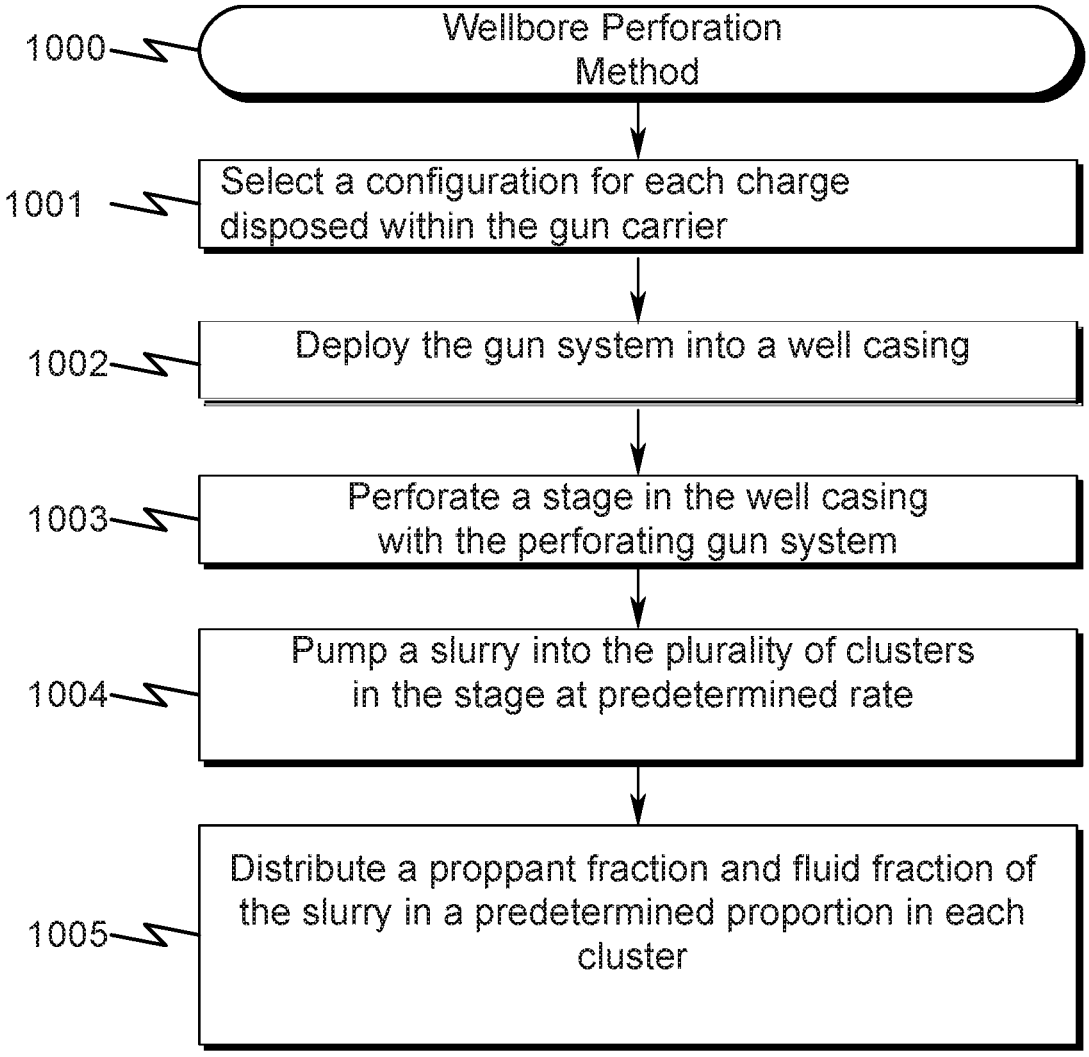
FIG. 10 is a simplified flowchart of an exemplary method using an exemplary perforating gun system of the present disclosure.

FIG. 10 is a simplified flowchart of another exemplary method depicting some of the steps using an exemplary perforating gun system of the present disclosure. The method 1000 includes the following steps: selecting a configuration for each perforating charge disposed within the gun carrier in step 1001; deploying the gun system into a well casing in step 1002; perforating a stage in the well casing with the perforating gun system in step 1003; pumping a slurry into the plurality of clusters in the stage at a predetermined rate in step 1004; and distributing a proppant fraction and fluid fraction of the slurry in a predetermined proportion in each cluster in step 1005.

The predetermined proportions in each cluster in some embodiments may be chosen to be equal, substantially equal (vary by +/−10%), or different from cluster to cluster. In other embodiments, the predetermined proportion of the proppant fraction may be chosen such that one or more clusters are biased with a larger proportion of proppant fraction when compared to one or more other clusters along the stage. For example, a predetermined proppant fraction bias may be achieved in one or any combination of a toe-ward cluster, a middle cluster, or a heel-ward cluster. In an exemplary embodiment, the angle of charges may be tailored to create angled perforation tunnels at a particular cluster and consequently a higher proppant concentration in slurry entering the cluster within a stage. In an exemplary embodiment, the perforating charge is a shaped charge.

Figure 11:
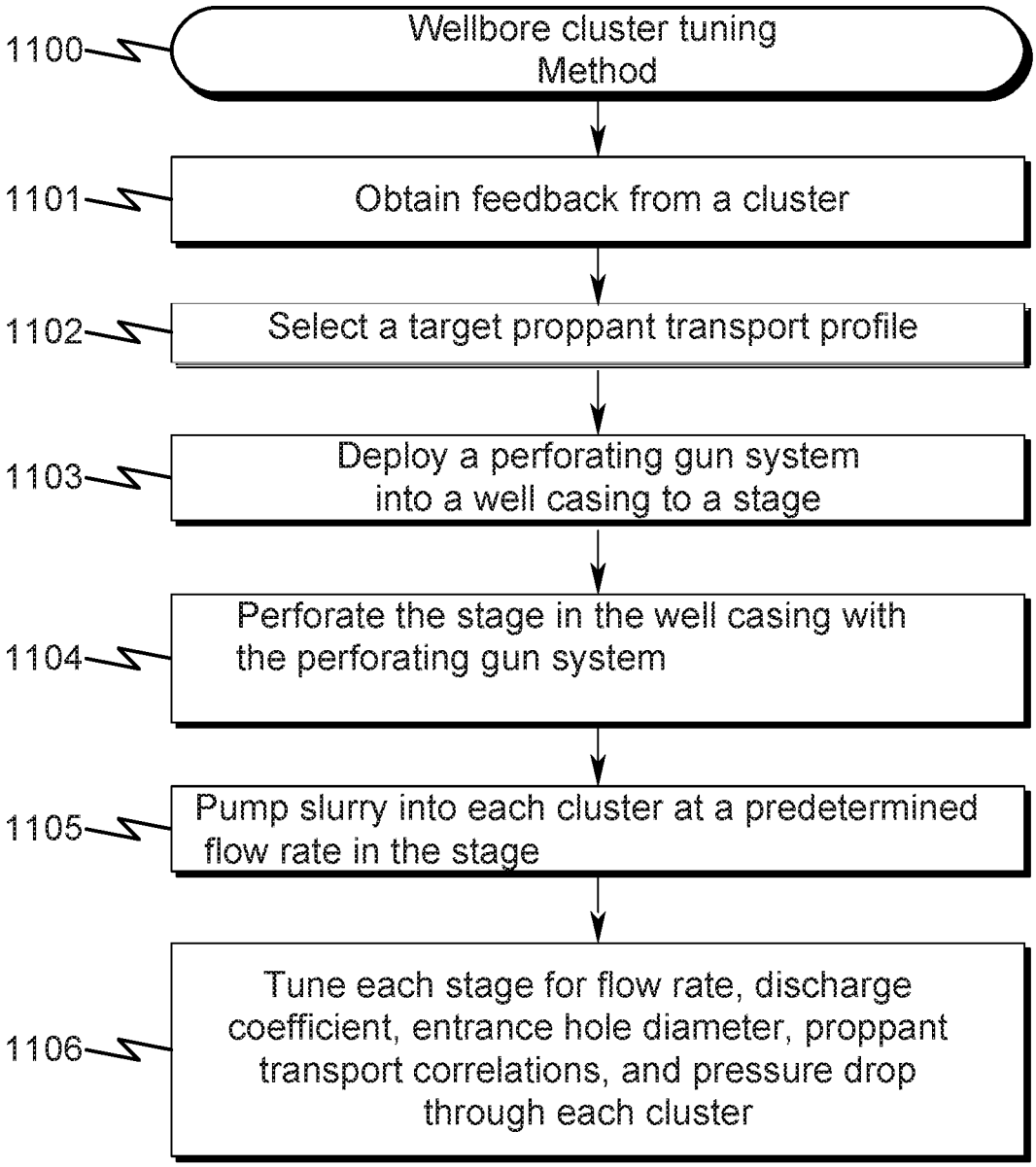
FIG. 11 is a simplified flowchart of an exemplary cluster tuning method using an exemplary perforating gun system of the present disclosure.

FIG. 11 is a simplified flowchart of a cluster tuning method using an exemplary perforating gun system of the present disclosure. The method 1100 includes the following steps: obtaining feedback from a feedback cluster in step 1101; selecting a target proppant transport profile in step 1102; deploying a perforating gun system into a well casing at a predetermined stage in step 1103; perforating the stage in the well casing with the perforating gun system in step 1104; pumping slurry into the cluster at a predetermined flow rate in the stage in step 1105; and tuning each stage for flow rate, discharge coefficient, entrance hole diameter, proppant transport correlations, and pressure drop through each cluster in step 1106.

In an exemplary embodiment, the feedback collected from the feedback cluster may be any one or more of a number of variables of interest. These may include, for example, any one or more of: flow rate, discharge coefficient, entrance hole diameter, proppant transport and pressure drop through perforation tunnels. The predetermined proportion of slurry in some embodiments may be chosen to be substantially equal (vary by +/−10%) in all clusters within a stage. In other embodiments, the predetermined proportion of the proppant fraction may be chosen such that one or more clusters are biased. For example, one or any combination of a toe-ward cluster, a middle cluster, or a heel-ward cluster. In an exemplary embodiment, the angle of charges may be tailored to intentionally create a higher proppant concentration in a particular cluster within a stage. In an exemplary embodiment, the perforation tunnel lengths may be tailored to create a higher proppant concentration in a particular cluster within a stage. In exemplary embodiments the predetermined slurry proportion, i.e., the ratio of proppant fraction to fluid fraction ranges from about 0.2 to about 0.8. In other exemplary embodiments the predetermined proportion ratio of proppant fraction to fluid fraction ranges from about 0.4 to about 0.6. Another mechanism of tuning a cluster is improving the discharge coefficient, which enables placement of a larger proppant fraction into a perforation tunnel within a cluster. The tuning of the cluster may provide a greater discharge coefficient allowing larger fractions of the proppant through smaller size holes thus improving the proppant transport efficiency. It may be appreciated that any one of these factors may be used to encourage, inhibit, or divert proppant transport through one cluster in order to affect or control activity at other clusters.

For example, a cluster may be tuned by changing the hole size of the precision charges and the liner angle of the charges to affect the discharge coefficient and/or proppant transport on a cluster by cluster basis so as to offset or enhance the flow of fracturing slurry into that cluster or subsequent clusters in the stage. In other exemplary embodiments, a cluster in a stage may be tuned by preselecting a target entrance hole diameter for perforations within the cluster. The characteristics of a cluster in one stage may be substantially the same to another corresponding cluster in another stage. A feedback from each of the clusters may be analyzed with systems such as distributed temperature sensing, distributed acoustic sensing, production and seismic analysis. Based on the feedback received in one cluster, the angle of perforation and the targeted entrance hole diameter may be customized with precision charges for a corresponding cluster in another stage such that the cluster may be fractured in a predetermined manner creating a bias or reducing a potential bias. For example, if a perforating system comprises 4 clusters, cluster1, cluster2, cluster3, and cluster4 from heel-ward to toe-ward. When the feedback data shows that a cluster4 nearest the toe is eroding faster than the other clusters due to more fluid flow, the charges of a corresponding cluster4 in another stage expected to behave in a similar fashion may be adjusted to counteract this phenomenon, for example they may be angled and the target entrance diameter may be reduced by 0.1 inches or more, so that the fluid flow is reduced and the proppant is distributed without causing erosion and bias in cluster4. The openings in cluster4 may be reduced based on the feedback and hence the cluster4 in each of the subsequent stages may be customized with precision charges that are angled. Similarly, cluster1, cluster2, and cluster3 may be tuned such that the proppant transport efficiency and discharge coefficient are improved. Along with precision shaped charges, it may be appreciated that other techniques, of which some may be known in the industry, may be used to customize features such as entrance hole diameters of a perforation, angling of a charge, and a perforation tunnel length.

Figure 12:
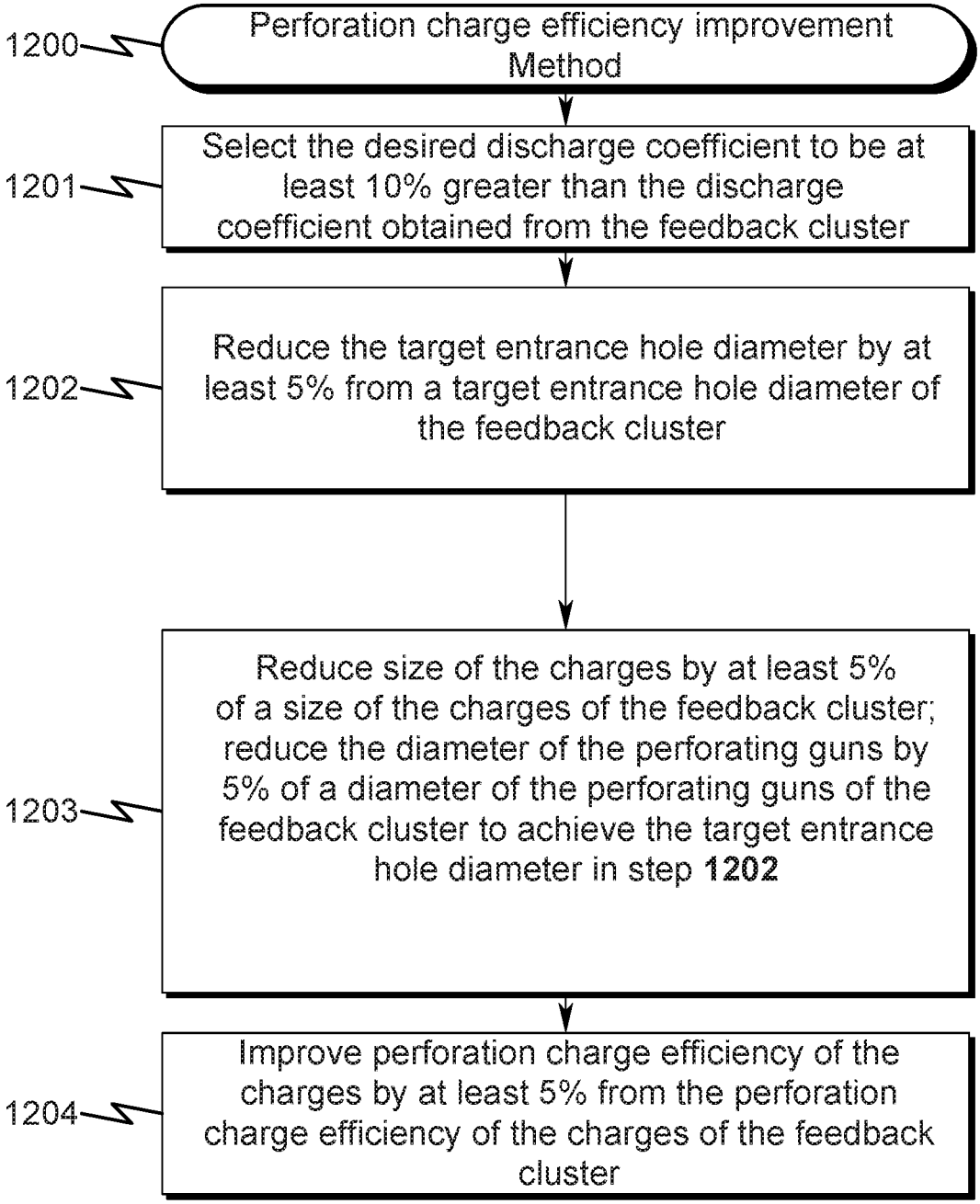
FIG. 12 is a simplified flowchart of an exemplary perforation charge efficiency improvement method using an exemplary perforating gun system of the present disclosure.

FIG. 12 is a simplified flowchart of a perforation charge efficiency improvement method using an exemplary perforating gun system of the present disclosure. The method 1200 includes the following steps: select a target discharge coefficient to be at least 10% greater than the discharge coefficient obtained from the feedback cluster in step 1201; reduce the target entrance hole diameter by at least 5% from a target entrance hole diameter of the feedback cluster in step 1202; reduce size of the charges by at least 5% of the size of the charges used in the feedback cluster; reduce the diameter of the perforating guns by 5% of a diameter of the perforating guns of the feedback cluster to achieve the target entrance hole diameter in step 1203; and improve perforation charge efficiency of the charges by at least 5% from the perforation charge efficiency of the charges of the feedback cluster in step 1204.

The term, "perforation charge efficiency," as used herein may be defined as a ratio of entrance hole size (length) to the weight (mass) of the explosive contained in the charge. For the purposes of the present disclosure, the entrance hole size is the entrance hole diameter such that the perforation charge efficiency is measured in inches per gram of explosive (in/gram). In practice, the perforation charge efficiency may also be measured in entrance hole area per gram of explosive ($in^2$/gram). For example, a single charge with 23 grams of explosive that creates a 0.40 in entrance hole diameter in a casing will have a lower perforating charge efficiency than another charge with only 18 grams of explosive that also creates a 0.40 in entrance hole diameter in the same size and type of casing. The efficiency of the charge may impact any one or a combination of the size of the hole that the explosive (charge) creates, the flow rate through the opening, and the pressure drop through the opening. In other embodiments, an improved discharge coefficient allows for the use of smaller guns with less explosive weight while achieving the same flow rate as a larger hole size with an lower discharge coefficient. For example, with an improved discharge coefficient, the weight of the charge could be lowered from 39 grams used in conventional systems to 23 grams with an exemplary system and create a 0.35 in diameter hole instead of a 0.4 in diameter hole and achieve the same flow rate through the 0.35 diameter hole as the 0.4 in diameter hole for the same pressure drop. An improved perforation charge efficiency allows for the use of smaller charges with lower weight explosive to achieve the same flow rate. Accordingly a smaller gun may be used at a cost savings.

EXAMPLES

FIGS. 13A-C are tables provided to illustrate the influence of various factors on the discharge coefficient. The tables include the discharge coefficient, pressure drops across perforations at various efficiency levels as measured by the percent of perforations open to fluid flow, and the average injection rates across perforations at various efficiency levels. FIG. 13A is an illustration of data taken from a conventional gun system. FIG. 13B showed the effect of increasing the discharge coefficient by using an exemplary gun system on reduced pressure drop across active perforations at a stage. FIG. 13C maintained the increased discharge coefficient produced using an exemplary gun system and the pressure drop of FIG. 13A to show that with an increased discharge coefficient, the total injection rate may be increased while maintaining the pressure drops across active perforations as listed in FIG. 13A.

For example, FIG. 13A showed an injection rate of 80 BPM in a stage with 36 perforations with target hole size of 0.4 inches in diameter. At 100% efficiency, the rate per perforation is the total rate of 80 barrels per minute (BPM) divided by 36 active perforations. At 90% efficiency, the average rate per perforation is 80 BPM divided by 90% of 36 perforations (32.4 perforations), and so forth. The pressure drop across the perforations can be calculated at various efficiencies using the estimated $C_v$ factor, flow rates, fluid density, and perforation diameter as shown in Equation (2A) and (2B). As shown in FIG. 13A, the pressure drop is 909 psi per perforation at 100% efficiency across the perforation at a total injection rate of 80 BPM and a discharge coefficient of 0.65.

Among other potential factors, the precision charges in an exemplary perforating gun system may be adjusted to influence the shape of the hole such as oval, circular, or elongated as well as the formation of a backstop burr which in turn may improve proppant transport and consequently the discharge coefficient ($C_v$) to 0.75 or higher as illustrated in FIG. 13B. When compared with FIG. 13A, FIG. 13B showed pressure drops lowered across the perforation openings indicative of an improved charge design that created perforations at a stage with a discharge coefficient of 0.75 or higher. As clearly illustrated, FIG. 13B showed a pressure drop of 683 psi with a $C_v$ of 0.75 while FIG. 13A showed a 909 psi pressure drop at 100% efficiency with a $C_v$ of 0.65 with the conventional charge design. The benefit of reduced pressure loss is that lower treating pressures can save significant cost and time.

Additionally as illustrated in FIG. 13C, the injection pumping rate may be increased to achieve the treating pressure across the perforations similar to FIG. 13A. For example, with the higher $C_v$ of 0.75 for the perforation openings and a 909 psi drop across the perforations at 100% efficiency, the injection pumping rate may be increased to 92.3 BPM or slightly less to account for friction down the pipe, at the same surface pressure. According to an exemplary embodiment, the method of modifying the charge design to achieve higher discharge coefficients allows to pump at significantly higher injection rates while keeping all the other conditions constant. Higher efficiency allows for higher pump rates in which a desired amount of slurry may be placed faster. Moreover confidence that placed holes are open allows for reduction in the number of perforations, increasing diversion, preventing over-design of systems while maintaining adequate stage quality.

ADDITIONAL DISCLOSURES

The following clauses are offered as further support of the disclosed invention.

Clause 1. A perforating gun comprising: a gun carrier; a plurality of perforating charges housed within the gun carrier, wherein the plurality of perforating charges in the gun carrier are arranged to form a first cluster and a second cluster when discharged in a stage of a well casing; and wherein when deployed downhole, at least some of the plurality of charges are angled toe-ward to create a plurality of perforation tunnels to achieve a predetermined proppant transport profile in a stage.

Clause 2. The perforating gun of Clause 1 wherein at least some of the plurality of perforating charges are non-reactive shaped charges.

Clause 3. The perforating gun of any preceding clause wherein at least some of the plurality of perforating charges are reactive shaped charges.

Clause 4. The perforating gun of any preceding clause wherein none of the plurality of charges are angled heel-ward.

Clause 5. The perforating gun of any preceding clause wherein at least some of the charges are angled at 90 degrees from the longitudinal axis.

Clause 6. The perforating gun of any preceding clause wherein the predetermined proppant transport profile comprises an even proppant distribution amongst each of a plurality of clusters.

Clause 7. The perforating gun of any preceding clause wherein the predetermined proppant transport profile comprises an uneven proppant distribution amongst each of a plurality of clusters.

Clause 8. The perforating gun of any preceding clause wherein the plurality of charges are phased equally around a longitudinal axis of the plurality of perforating guns.

Clause 9. The perforating gun of any preceding clause wherein the plurality of charges are phased unequally around a longitudinal axis of the plurality of perforating guns.

Clause 10. The perforating gun of any preceding clause wherein the plurality of charges are positioned such that spacing between two adjacent said plurality of charges is equal.

Clause 11. The perforating gun of any preceding clause wherein the plurality of charges are positioned such that spacing between two adjacent said plurality of charges is unequal.

Clause 12. The perforating gun of any preceding clause wherein each of the plurality of perforation tunnels have an entrance hole diameter within 20% of a target entrance hole diameter.

Clause 13. The perforating gun of any preceding clause wherein the perforating gun outer diameter is 2⅞ inches or larger.

Clause 14. The perforating gun of any preceding clause wherein each of the plurality of perforation tunnels comprise an entrance hole configured with burrs; wherein the burrs further enable transport of a proppant fraction through the perforation tunnels.

Clause 15. The perforating gun of any preceding clause wherein an angle relative to a longitudinal axis of the well casing of each of the plurality of perforating tunnels ranges from 50 to 900.

Clause 16. The perforating gun of any preceding clause wherein an angle relative to a longitudinal axis of the well casing of each of the plurality of tunnels is equal.

Clause 17. The perforating gun of any preceding clause wherein the angle relative to a longitudinal axis of the well casing of each of the plurality of tunnels is unequal.

Clause 18. A perforating gun system comprising: a plurality of perforating guns, the at least one perforating gun comprising a gun carrier, and a plurality of perforating charges housed within the gun carrier; wherein the plurality of shaped charges in the gun system are arranged to form at least a first cluster and a second cluster when discharged in a stage of a well casing; and wherein when deployed downhole, at least some of the plurality of perforating charges are angled toe-ward to create a plurality of perforation tunnels to achieve a predetermined proppant transport profile in a stage.

Clause 19. The perforating gun of Clause 18 wherein each of the plurality of perforating charges are non-reactive shaped charges.

Clause 20. The perforating gun of any preceding clause wherein each of the plurality of perforating charges are reactive shaped charges.

Clause 21. The perforating gun of any preceding clause wherein none of the plurality of charges are angled heel-ward.

Clause 22. The perforating gun of any preceding clause wherein at least some of the charges are angled at 90 degrees from the longitudinal axis.

Clause 23. The perforating gun of any preceding clause wherein the predetermined proppant transport profile comprises an even proppant distribution amongst each of a plurality of clusters.

Clause 24. The perforating gun of any preceding clause wherein the predetermined proppant transport profile comprises an uneven proppant distribution amongst each of a plurality of clusters.

Clause 25. The perforating gun of any preceding clause wherein the plurality of charges are phased equally around a longitudinal axis of the plurality of perforating guns.

Clause 26. The perforating gun of any preceding clause wherein the plurality of charges are phased unequally around a longitudinal axis of the plurality of perforating guns.

Clause 27. The perforating gun of any preceding clause wherein the plurality of charges are positioned such that spacing between two adjacent said plurality of charges is equal.

Clause 28. The perforating gun of any preceding clause wherein the plurality of charges are positioned such that spacing between two adjacent said plurality of charges is unequal.

Clause 29. The perforating gun of any preceding clause wherein each of the plurality of perforation tunnels have an entrance hole diameter within 20% of a target entrance hole diameter.

Clause 30. The perforating gun of any preceding clause wherein the perforating gun outer diameter is 2⅞ inches or larger.

Clause 31. The perforating gun of any preceding clause wherein each of the plurality of perforation tunnels comprise an entrance hole configured with burrs; wherein the burrs further enable transport of a proppant fraction through the perforation tunnels.

Clause 32. The perforating gun of any preceding clause wherein an angle relative to a longitudinal axis of the well casing of each of the plurality of perforating tunnels ranges from 50 to 900.

Clause 33. The perforating gun of any preceding clause wherein an angle relative to a longitudinal axis of the well casing of each of the plurality of tunnels is equal.

Clause 34. The perforating gun of any preceding clause wherein the angle relative to a longitudinal axis of the well casing of each of the plurality of tunnels is unequal.

Clause 35. A perforating method comprising: providing a perforating gun system comprising one or more perforating guns in a gun string, each gun comprising a gun carrier, a plurality of perforating charges housed within the gun carrier; selecting an arrangement for each perforation charge, wherein at least some of the plurality of perforating charges are angled toe-ward; deploying the perforating gun system into the well casing in a stage; perforating at the stage and creating at least a first and a second cluster, wherein each cluster comprises a plurality of perforation tunnels, wherein each of the plurality of tunnels are oriented in a predetermined arrangement; pumping a slurry into the clusters at a predetermined flow rate; and distributing a proppant fraction and a fluid fraction of the slurry in a predetermined proportion in each cluster.

Clause 36. The perforating method of Clause 35 wherein each of a plurality of angles of each of the plurality of perforation tunnels relative to the longitudinal axis of the casing ranges from 5° to 90°.

Clause 37. The perforating method of any preceding clause wherein each of a plurality of angles of each of the plurality of perforation tunnels relative to the longitudinal axis of the casing is equal.

Clause 38. The perforating method of any preceding clause wherein each of a plurality of angles of each of the plurality of perforation tunnels relative to the longitudinal axis of the casing is unequal.

Clause 39. The perforating method of any preceding clause wherein each of the plurality of perforation tunnels have an entrance hole diameter within 20% of a target entrance hole diameter.

Clause 40. The perforating method of any preceding clause wherein none of the plurality of charges are angled heel-ward.

Clause 41. The perforating method of any preceding clause wherein at least some of the charges are angled at 90 degrees from the longitudinal axis.

Clause 42. A fracturing method comprising: perforating at a stage of a well casing and creating at least a first and a second cluster, wherein each cluster comprises plurality of perforation tunnels, wherein each of the plurality of perforation tunnels are oriented in a predetermined arrangement; pumping a slurry into the well casing at a predetermined flow rate; and distributing a proppant fraction and a fluid fraction of the slurry in a predetermined proportion in each cluster.

Clause 43. The fracturing method of Clause 42, further comprising: obtaining feedback from a feedback cluster; and selecting a target proppant transport profile.

Clause 44. The fracturing method of any preceding clause wherein the target proppant transport profile is determined using a target discharge coefficient.

Clause 45. The fracturing method of any preceding clause wherein the target transport profile is determined using a target proppant transport efficiency correlation.

Clause 46. The fracturing method of any preceding clause wherein the desired proportion of the proppant fraction and the fluid fraction is substantially unequal through each of the plurality of clusters.

Clause 47. The fracturing method of any preceding clause wherein the desired proportion of the proppant fraction and the fluid fraction is unequal through each of the plurality of clusters.

Clause 48. The fracturing method of any preceding clause wherein each of the plurality of charges create perforations with burrs; the burrs further enable transport of the proppant fraction through the perforation tunnels.

Clause 49. The fracturing method of any preceding clause wherein each of the plurality of perforation tunnels have an entrance hole diameter within 20% of a target entrance hole diameter.

Clause 50. The fracturing method of any preceding clause further comprises the steps of:

(1) selecting a desired discharge coefficient to be at least 10% greater than the discharge coefficient obtained from the feedback cluster;
(2) reducing the target entrance hole diameter by at least 5% from a target entrance hole diameter of the feedback cluster;
(3) reducing the size of the charges by at least 5% of a size of the charges of the feedback cluster by reducing the diameter of the perforating guns by at least 5% of a diameter of the perforating guns of the feedback cluster to achieve the target entrance hole diameter in step (2); and
(4) improving perforation charge efficiency of the charges by at least 5% from the perforation charge efficiency of the charges of the feedback cluster.

Clause 51. The fracturing method of any preceding clause wherein the step of selecting a configuration for each shaped charge further comprises adjusting a target angle in a plurality of angles for each shaped charge based on the feedback from the feedback cluster.

Clause 52. The perforating method of any preceding clause wherein the step of selecting a configuration for each shaped charge further comprises adjusting a target perforation tunnel length in a plurality of perforation tunnel lengths for each shaped charge based on the feedback from the feedback cluster.

Clause 53. The perforating method of any preceding clause wherein the feedback comprises flow rate, discharge coefficient, entrance hole diameter, proppant transport and pressure drop through perforation tunnels.

Clause 54. The perforating method of any preceding clause further comprises the steps of:

(1) tuning each of the clusters in a stage;
(2) tuning each stage for flow rate, discharge coefficient, entrance hole diameter, proppant transport correlations and pressure drop through perforation tunnels; and
(3) completing each of the stages.

Clause 55. The perforating method of any preceding clause wherein the desired proportion of the proppant fraction and fluid fraction ranges from 0.2 to 0.8.

Clause 56. The perforating method of any preceding clause wherein the step of obtaining feedback from the feedback cluster comprises a feedback system using distributed temperature sensing.

Clause 57. The perforating method of any preceding clause wherein the step of obtaining feedback from the feedback cluster comprises a feedback system using distributed acoustic sensing.

Clause 58. The perforating method of any preceding clause wherein the step of obtaining feedback from the feedback cluster comprises a feedback system using microseismic monitoring.

Although the present disclosure has provided many examples of systems, apparatuses, and methods, it should be understood that the components of the systems, apparatuses and method described herein are compatible and additional embodiments can be created by combining one or more elements from the various embodiments described herein. As an example, in some embodiments, a method described herein can further comprise one or more elements of a system described herein or a selected combination of elements from any combination of the systems or apparatuses described herein.

Furthermore, in some embodiments, a method described herein can further comprise using a system described herein, using one or more elements of a system described herein, or using a selected combination of elements from any combination of the systems described herein.

Although embodiments of the invention have been described with reference to several elements, any element described in the embodiments described herein are exemplary and can be omitted, substituted, added, combined, or rearranged as applicable to form new embodiments. A skilled person, upon reading the present specification, would recognize that such additional embodiments are effectively disclosed herein. For example, where this disclosure describes characteristics, structure, size, shape, arrangement, or composition for an element or process for making or using an element or combination of elements, the characteristics, structure, size, shape, arrangement, or composition can also be incorporated into any other element or combination of elements, or process for making or using an element or combination of elements described herein to provide additional embodiments. For example, it should be understood that the method steps described herein are exemplary, and upon reading the present disclosure, a skilled person would understand that one or more method steps described herein can be combined, omitted, re-ordered, or substituted.

Additionally, where an embodiment is described herein as comprising some element or group of elements, additional embodiments can consist essentially of or consist of the element or group of elements. Also, although the open-ended term "comprises" is generally used herein, additional embodiments can be formed by substituting the terms "consisting essentially of" or "consisting of."

Where language, for example, "for" or "to", is used herein in conjunction with an effect, function, use or purpose, an additional embodiment can be provided by substituting "for" or "to" with "configured for/to" or "adapted for/to."

Additionally, when a range for a particular variable is given for an embodiment, an additional embodiment can be created using a subrange or individual values that are contained within the range. Moreover, when a value, values, a range, or ranges for a particular variable are given for one or more embodiments, an additional embodiment can be created by forming a new range whose endpoints are selected from any expressly listed value, any value between expressly listed values, and any value contained in a listed range. For example, if the application were to disclose an embodiment in which a variable is 1 and a second embodiment in which the variable is 3-5, a third embodiment can be created in which the variable is 1.31-4.23. Similarly, a fourth embodiment can be created in which the variable is 1-5.

As used herein, examples of "substantially" include: "more so than not," "mostly," and "at least 30, 40, 50, 60, 70, 80, 90, 95, 96, 97, 98 or 99%" with respect to a referenced characteristic. With respect to vectors, directions, movements or angles, that are "substantially" in the same direction as or parallel to a reference vector, direction, movement, angle or plane, "substantially" can also mean "at least a component of the vector, direction, movement or angle specified is parallel to the reference vector, direction, movement, angle or plane," although substantially can also mean within plus or minus 45, 40, 35, 30, 25, 20, 15, 10, 5, 4, 3, 2, or 1 degrees of the reference vector, direction, movement, angle or plane.

As used herein, examples of "about" and "approximately" include a specified value or characteristic to within plus or minus 30, 25, 20, 15, 10, 5, 4, 3, 2, or 1% of the specified value or characteristic.

While this invention has been particularly shown and described with reference to exemplary embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A perforating gun comprising:

a gun carrier;

a plurality of perforating charges housed within the gun carrier;

wherein the plurality of perforating charges in the gun carrier are arranged to form a first cluster and a second cluster when discharged in a stage of a well casing; and wherein when deployed downhole, at least some of the plurality of charges are angled toe-ward to create a plurality of perforation tunnels to achieve a predetermined proppant transport profile in the stage, wherein each of the plurality of perforation tunnels comprises an entrance hole configured with burrs, and wherein the burrs further enable transport of a proppant fraction through the perforation tunnels.

2. The perforating gun of claim 1 wherein at least some of the plurality of perforating charges are reactive shaped charges.

3. The perforating gun of claim 1 wherein the predetermined proppant transport profile comprises an even proppant distribution amongst each of a plurality of clusters.

4. The perforating gun of claim 1 wherein the plurality of charges are phased equally around a longitudinal axis of the plurality of perforating guns.

5. The perforating gun of claim 1 wherein the plurality of charges are positioned such that spacing between two adjacent said plurality of charges is equal.

6. The perforating gun of claim 1 wherein each of the plurality of perforation tunnels have an entrance hole diameter within 20% of a target entrance hole diameter.

7. The perforating gun of claim 1 wherein an angle relative to a longitudinal axis of the well casing of each of the plurality of perforating tunnels ranges from 5° to 90°.

8. The perforating gun of claim 1 wherein an angle relative to a longitudinal axis of the well casing of each of the plurality of tunnels is equal.

9. A perforating gun system comprising:

a plurality of perforating guns comprising a gun carrier, and a plurality of perforating charges housed within the gun carrier;

wherein the plurality of perforating charges in the gun system are arranged to form at least a first cluster and a second cluster when discharged in a stage of a well casing;

wherein when deployed downhole, at least some of the plurality of perforating charges are angled toe-ward to create a plurality of perforation tunnels to achieve a predetermined proppant transport profile in the stage;

wherein each of the plurality of perforation tunnels comprises an entrance hole configured with burrs; and wherein the burrs further enable transport of a proppant fraction through the perforation tunnels.

10. The perforating gun system of claim 9 wherein each of the plurality of perforating charges are reactive shaped charges.

11. The perforating gun system of claim 9 wherein the predetermined proppant transport profile comprises an even proppant distribution amongst each of a plurality of clusters.

12. The perforating gun system of claim 9 wherein the plurality of charges are phased equally around a longitudinal axis of the plurality of perforating guns.

13. The perforating gun system of claim 9 wherein the plurality of charges are positioned such that spacing between two adjacent said plurality of charges is equal.

14. The perforating gun system of claim 9 wherein each of the plurality of perforation tunnels have an entrance hole diameter within 20% of a target entrance hole diameter.

15. The perforating gun system of claim 9 wherein an angle relative to a longitudinal axis of the well casing of each of the plurality of perforating tunnels ranges from 5° to 90°.

16. The perforating gun system of claim 9 wherein an angle relative to a longitudinal axis of the well casing of each of the plurality of tunnels is equal.

17. A perforating method comprising:

providing a perforating gun system comprising one or more perforating guns in a gun string, each gun comprising a gun carrier and a plurality of perforating charges housed within the gun carrier;

selecting an arrangement for each perforation charge, wherein at least some of the plurality of perforating charges are angled toe-ward;

deploying the perforating gun system into the well casing in a stage; and perforating at the stage and creating at least a first cluster and a second cluster, wherein each cluster comprises a plurality of perforation tunnels, wherein each of the plurality of tunnels are oriented in a predetermined arrangement, wherein each of the plurality of perforation tunnels comprises an entrance hole configured with burrs, and wherein the burrs further enable transport of a proppant fraction through the perforation tunnels.

18. The perforating method of claim 17 wherein each of a plurality of angles of each of the plurality of perforation tunnels relative to the longitudinal axis of the casing ranges from 5° to 90°.

19. The perforating method of claim 17 wherein each of the plurality of perforation tunnels have an entrance hole diameter within 20% of a target entrance hole diameter.

* * * * *